United States Patent [19]

Bristow et al.

[11] Patent Number: 4,673,485

[45] Date of Patent: Jun. 16, 1987

[54] PROCESS FOR INCREASING DEASPHALTED OIL PRODUCTION FROM UPGRADED RESIDUA

[75] Inventors: Duncan J. Bristow; Biddanda U. Achia, both of Sarnia; Lawrence J. Evers, Brights Grove, all of Canada

[73] Assignee: Exxon Research and Engineering Company, Florham Park, N.J.

[21] Appl. No.: 597,437

[22] Filed: Apr. 6, 1984

[51] Int. Cl.[4] ..... C10C 3/00; C10G 1/00; C10G 1/04

[52] U.S. Cl. ..... 208/86; 208/309; 208/87

[58] Field of Search ..... 208/86, 309, 349, 87

[56] References Cited

U.S. PATENT DOCUMENTS

| | | | |
|---|---|---|---|
| 2,079,886 | 5/1937 | Voorhees . | |
| 2,086,487 | 7/1937 | Bahlke et al. . | |
| 2,500,757 | 3/1950 | Kiersted . | |
| 2,570,044 | 10/1951 | Benedict et al. . | |
| 2,700,637 | 1/1955 | Knox . | |
| 2,834,715 | 6/1954 | Pratt . | |
| 2,850,431 | 9/1958 | Smith | 208/86 |
| 2,853,426 | 9/1958 | Peet . | |
| 2,882,218 | 4/1959 | Johnson . | |
| 2,882,219 | 4/1959 | Johnson | 208/86 |
| 2,895,902 | 7/1959 | Peet . | |
| 2,925,374 | 2/1960 | Gwin et al. . | |
| 2,953,501 | 9/1960 | Mignone . | |
| 3,423,308 | 1/1969 | Murphy . | |
| 3,998,726 | 12/1976 | Bunas et al. . | |
| 4,062,758 | 12/1977 | Goudriaun et al. | 208/86 |
| 4,207,168 | 1/1980 | Simone . | |
| 4,239,616 | 12/1980 | Gearhart . | |
| 4,305,812 | 12/1981 | Shih et al. . | |
| 4,395,330 | 7/1983 | Auboir et al. | 208/86 |
| 4,454,023 | 6/1984 | Lutz | 208/309 |
| 4,486,295 | 12/1984 | Inooka | 208/97 |
| 4,500,416 | 2/1985 | Dongen et al. | 208/86 |
| 4,534,854 | 8/1985 | Weinberg et al. | 208/86 |

*Primary Examiner*—Andrew H. Metz
*Assistant Examiner*—Chung K. Pak
*Attorney, Agent, or Firm*—Robert J. North; Joseph J. Allocca

[57] ABSTRACT

A process in fuels production for increasing the yield of deasphalted oil production from upgraded residua and improving deasphalter operability involving mixing the upgraded residua with an aromatics solubilizing aid to prevent the formation of an immiscible third phase during deasphalting.

4 Claims, 1 Drawing Figure

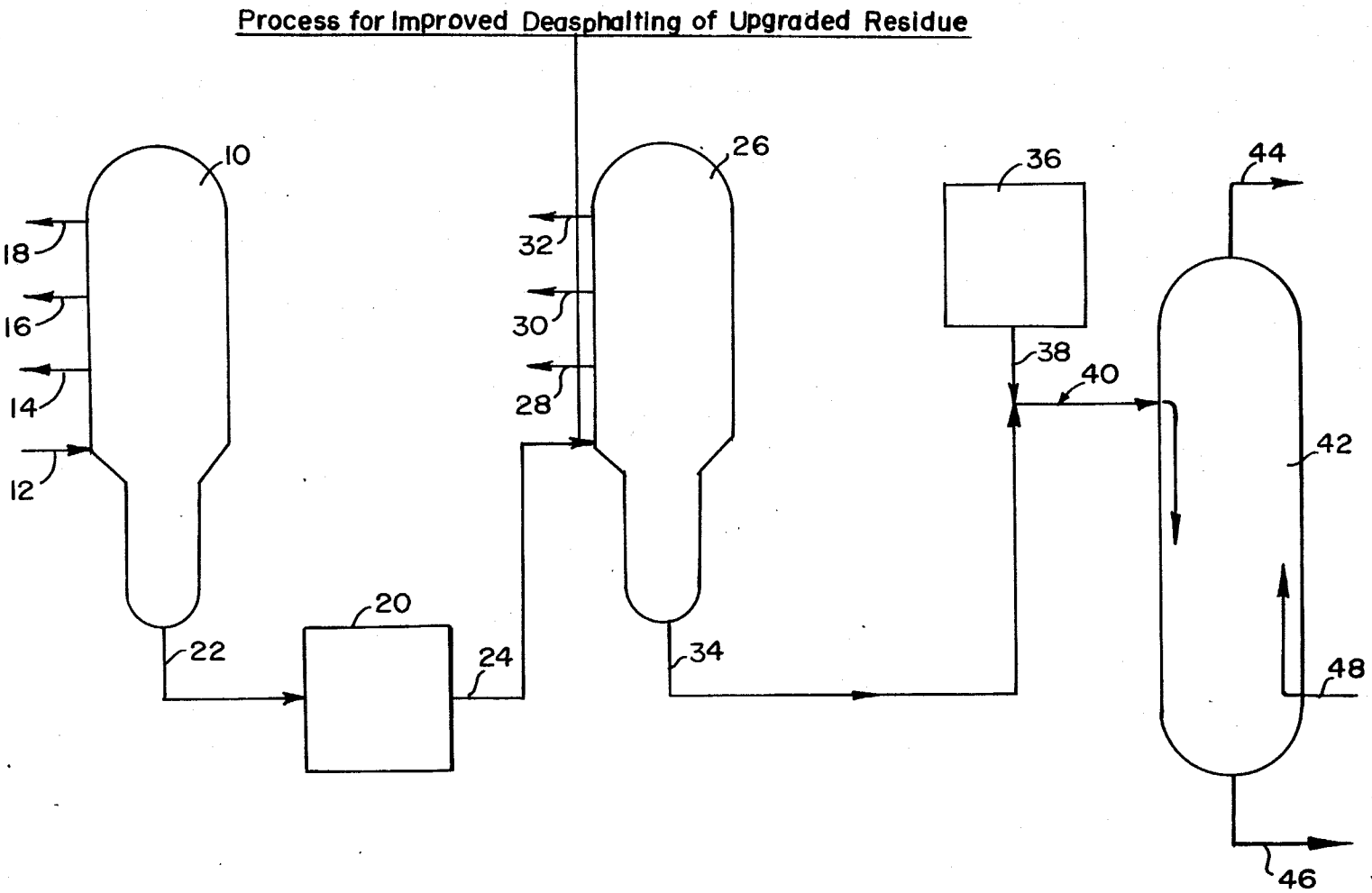
Process for Improved Deasphalting of Upgraded Residue
10
12
14
16
18
20
22
24
26
28
30
32
34
36
38
40
42
44
46
48

PROCESS FOR INCREASING DEASPHALTED OIL PRODUCTION FROM UPGRADED RESIDUA

BACKGROUND OF THE INVENTION

The present invention is primarily directed to cat cracker feed manufacture as used in fuels operations. More specifically, the present invention is directed at increased production of deasphalted oil and improved deasphalter operability in fuels processes.

Due to the decreasing quality of crudes and concomitant increase in the yield of residual oil fractions, residual oil upgrading processes have been included in many refineries. These upgrading conversion processes, which usually involve some form of catalytic treatment in a hydrogen atmosphere such as RESIDfining TM as described in Hydrocarbon Processing, September, p. 130 (1982), or resid visbreaking as described in Hydrocarbon Processing, January, p. 131 (1979) and Oil and Gas Journal, 79, (No. 15) p. 109 (1981), all three references hereby incorporated by reference, increase the yield of lighter products in both the distillation and deasphalting steps.

However, increased use of upgraded residua has resulted in the knowledge that the operation and capacity of a fuels deasphalting tower is substantially dependent upon the nature of the residua feed. Catalytic upgrading or thermal visbreaking of a residual oil prior to deasphalting results in large decreases in deasphalter capacity, efficiency, and considerable loss in deasphalted oil yield.

The principal cause of this situation is the result of formation of a three-phase system, in which the third phase is usually an immiscible solid asphaltic mixture, which is incompatible with both the deasphalted oil extract and the asphaltic raffinate phases. Thus, any modification to a deasphalting process which tends to reduce or eliminate formation of this third phase when using upgraded residua would simultaneously increase yield and capacity and would represent a major benefit to a refiner.

U.S. Pat. Nos. 2,700,637, 2,934,715 and 2,882,219 disclose the addition of cycle oil or decant oil (Cat Fractionator Bottoms), respectively, to a deasphalter feed in order to increase the yield and quality of suitable catalytic cracking feedstock. In each of these cases, the deasphalter feed constitutes a conventional vacuum residual oil which has not been catalytically or thermally pretreated, which has been found to be the necessary condition for immiscibility via third phase formation in a fuels deasphalting operation. None of these patents include any teaching for overcoming this third phase formation and providing improved deasphalter and feed heat exchanger operability, specifically utilizing an upgraded vacuum residuum.

U.S. Pat. No. 2,570,044 discloses recycling of an aromatic extract oil stream derived from a deasphalted oil to a deasphalter feed during lubes production. This is disclosed as being carried out in order to eliminate the formation of a third phase which tends to foul the deasphalter internals. However, the deasphalter feed cited in U.S. Pat. No. 2,570,044 has not been subjected to an upgrading process. Further, the nature of the third phase must be considerably dissimilar to that discussed in the present invention since addition of an aromatic extract oil derived from a deasphalted oil is not successful in the suppression of third phase formation during the deasphalting of an upgraded residuum.

What is desired in the art is a process in which the overall production of deasphalted oil is maximized while maintaining specification quality for fuels manufacture derived from vacuum distilled residua that have been catalytically treated or thermally treated in a residuum upgrading step. The specifications involve maintaining a low Conradson Carbon Residue and low metals content, so that valuable fuels end products can be produced by further processing.

SUMMARY OF THE INVENTION

It has been found that formation of a three-phase system, which occurs during the deasphalting step when contacting a catalytically treated vacuum residuum with deasphalting solvent, can be inhibited and suppressed by the addition of a solubilizing aid, which contains a substantial amount of aromatic material, and is soluble in both the deasphalting raffinate, and extract. The use of cat cracker bottoms containing a substantial amount of aromatic material, has resulted in improved deasphalter operability and yields using upgraded deasphalter feed which has been catalytically or thermally pretreated.

By the present invention there is provided a process for increasing the production of deasphalted oil from a hydrocarbon feedstock comprising the steps of:

(a) contacting an upgraded distillation residuum, derived from a hydrocarbon feedstock, and a solubilizing aid, with a deasphalting solvent producing a first phase liquid deasphalted oil extract and a second phase heavier liquid asphaltic raffinate, wherein said solubilizing aid inhibits the formation of an immiscible asphaltic third phase, by promoting the solubility of said third phase in said second phase liquid asphaltic raffinate, during the contacting step; and (b) recovering said first phase liquid deasphalted oil extract.

Improved deasphalter operability is also provided by the process which further comprises:

(a) passing a hydrocarbon feedstock into a first distillation zone wherein the feedstock is separated into distillates and a first residuum;

(b) passing the first residuum into a residuum upgrading zone wherein an upgraded first residuum is produced;

(c) passing the upgraded first residuum into a second distillation zone wherein it is separated into distillates and a second residuum;

(d) passing the second residuum and a solubilizing aid into a deasphalting zone wherein the second residuum and solubilizing aid are contacted with a deasphalting solvent producing a first phase liquid deasphalted oil extract and a second phase heavier asphaltic raffinate, wherein said solubilizing aid inhibits the formation of an immiscible third asphaltic phase by promoting the solubility of said third phase in said second phase liquid asphaltic raffinate.

In a preferred process, the first and second distillation zones comprise atmospheric and vacuum distillation zones, respectively. The feed to the deasphalting zone preferably comprises residuum and between about 5 and about 90 liquid-volume (LV) percent solubilizing aid, which is also referred to in the art as an aromatic stream, more preferably between about 20 and about 70 LV percent solubilizing aid, and most preferably between about 30 and 60 LV percent solubilizing aid. The residuum added to the deasphalting zone may comprise residuum from the second distillation zone or upgraded residuum from a different distillation facility. The solubilizing aid, or aromatic stream, which is at least LV% soluble in the raffinate phase, can be cat cracker fractionator bottoms preferably having a boiling point not less than 260° C. (1 atm.), and not more than 430° C. (1 atm.), non-upgraded residuum which preferably has a boiling point not less than 370° C. (1 atm.); heavy cycle gas oil, having a boiling point range of 200° to 420° C. (1 atm.); and heavy coker gas oil, having a boiling point range of 300° to 550° C. (1 atm.). Excluded as solubilizing aids are extract oils derived from solvent extraction of deasphalted oils. The feed to the cat cracker can originate from either RESIDfined or non-RESIDfined crude material.

Residuum upgrading can take place after the first distillation zone and before the second distillation zone and/or after the second distillation zone and before the deasphalting zone.

In a preferred embodiment, the first residuum is upgraded after a first atmospheric distillation zone and passed to a second vacuum distillation zone. The second residuum is admixed with preferably 30 to 60 LV percent of the solubilizing aid, being catalytic cracker fractionator tar bottoms, and deasphalted. The solvent utilized in the deasphalting zone comprises a $C_2$–$C_8$ aliphatic hydrocarbon and is preferably 80/20 LV% propane/butane.

DESCRIPTION OF THE DRAWINGS

The FIGURE is a simplified flow diagram of a preferred embodiment for practicing the subject invention.

DETAILED DESCRIPTION OF THE INVENTION

The FIGURE illustrates a simplified process diagram for practicing the subject invention in which pipes, valves, and instrumentation not necessary for an understanding of this invention, and which will be readily apparent to one skilled in the art, have been deleted. The process described herein can be conducted in a batchwise or continuous manner.

A hydrocarbon feedstock such as reduced crude is shown entering first distillation zone 10 through line 12. Distillate is shown being withdrawn from zone 10 through lines 14, 16 and 18. First residuum from zone 10 passes to upgrading zone 20 through line 22. First residuum is shown passing from upgrading zone 20 through line 24 into second distillation zone 26, where the first upgraded residuum is separated into a second residuum, exiting zone 26 through line 34 and second distillates exiting zone 26 through lines 28, 30 and 32. The feed entering deasphalting zone 42 through line 40 is an admixture of an aromatic stream, being the solubilizing aid, which can be cat cracker bottoms, from zone 36 and preferably comprises from about 5 to about 90 LV%, more preferably from about 20 to about 70 LV%, and most preferably between about 30 and 60 LV% of the total feed, is directed to deasphalting zone 42 via line 38 in admixture with the second residuum from line 34. The deasphalting solvent is added through line 48 which passes counter-currently to the entering admixed feedstream, producing a deasphalted oil solution, or extract, exiting deasphalting zone 42 through line 44, and an asphaltic raffinate exiting deasphalting zone 42 through line 46.

As described more fully hereinafter, the subject process may produce an increased quantity of deasphalted oil for fuels processing compared to a conventional process in which the total feed for deasphalting zone 42 is the second residuum passed directly from second distillation zone 26 to deasphalting zone 42.

First distillation zone 10 typically comprises an atmospheric distillation zone, or atmospheric pipe still. Distillation zone 10 commonly is a packed or a trayed column. The bottoms temperature of zone 10 typically is maintained within the range of about 260° to about 415° C., while the bottoms pressure is maintained within the range of about 25 to about 260 cm Hg absolute, and preferably about atmospheric. The specific conditions employed will be a function of several variables, including the feed utilized, the distillate specifications, and the relative amounts of distillate and bottoms desired. Typically, the residuum content of the crude feed is between about 10 and 50 weight percent of the total crude feed.

The residuum upgrading zone 20 is typically a catalytic hydroconversion or hydrotreating process unit, a typical example of which is RESIDfining TM, licensed by the Exxon Research and Engineering Co. (Hydrocarbon Processing, September 1982, p. 130) and is well known in the art. Conversion of a feed in zone 20 at an operating temperature (°T) is defined as:

$$LV \text{ Percent Conversion } (^\circ T) = \frac{\text{Volume Feed} - \text{Volume Products}}{\text{Volume Feed}} \times 100$$

where the volume of products is defined as the volume boiling above the minimum boiling point of the feed to zone 20. LV (liquid-volume) Percent Conversion is typically from 10 to 70 LV percent and more typically from 30 to 60 LV percent. Preferably, the upgrading zone is operated at 315°–425° C. and absolute pressure of 4000–10,000 cm Hg.

In a preferred embodiment, the first residuum (22) is upgraded by a catalytic hydroconversion process in zone 20. However, upgrading of the second residuum (34) and/or asphalt (46) prior to admixing with the aromatic stream (38) and/or second residuum (34) is another useful practice of this invention. Other upgrading processes such as visbreaking, being a thermal upgrading unit process, are also operable within the scope of this invention.

Second distillation zone 26 typically comprises a vacuum distillation zone, or vacuum pipestill. Distillation zone 26 commonly is a packed or a trayed column. The bottoms temperature of zone 26 typically is maintained within the range of about 350° to about 450° C., while the bottoms pressure is maintained within the range of 5 to about 15 cm Hg. The specific conditions employed will be a function of several variables, including the feed utilized, the distillate specifications, and the relative amounts of distillate and bottoms desired. Typically, the residuum comprises between about 10 and about 50 weight percent of the upgraded first residuum feed, and has a boiling point (1 atm.) above about 370° C.

The operation of deasphalting zones is well-known by those skilled in the art. Deasphalting zone 42 typically will comprise a contacting zone, preferably a counter-current contacting zone, in which the hydrocarbon feed entering through line 42 is contacted with a solvent, such as a liquid light alkane hydrocarbon. Deasphalting zone 42 preferably includes internals adapted to promote intimate liquid-liquid contacting, such as sieve trays or shed row contactors. The extract stream, comprising deasphalted oil and a major portion of the solvent, exits the deasphalting zone 42 for further separation of the deasphalted oil from the solvent fractions, with the solvent fraction recirculated to deasphalting zone 42 for reuse. The preferred solvents generally used for deasphalting include $C_2$–$C_8$ alkanes, i.e., ethane, propane, butane, pentane, hexane, heptane and octane, with the most preferred being propane, butane, pentane and mixtures thereof, particularly being an 80% propane/20% butane v/v mixture. The operating conditions for deasphalting zone 40 are dependent, in part, upon the solvent utilized, the solvent-to-feed ratio, the characteristics of the hydrocarbon feedstock, and the physical properties of the deasphalted oil or asphalt desired. The solvent treat typically will range between about 200 liquid-volume percent (LV%) and about 1000 LV% of the total second distillate and residuum feed added to deasphalting zone 42. A discussion of deasphalting operation is presented in Advances in Petroleum Chemistry and Refining, Volume 5, pages 284–291, John Wiley and Sons, New York, N.Y. (1962), the disclosure of which is incorporated by reference. The deasphalted oil fraction may then be passed through a catalytic cracking unit to produce desirable fuels products.

The following examples are illustrative of the best mode of carrying out the instant invention as contemplated by us and should not be construed as being limits on the scope or spirit of the instant invention.

EXAMPLE 1

To illustrate the instant invention, cat cracker fractionator tar bottoms from a fluidized catalytic cracker unit (FCCU) and a vacuum distilled RESIDfined atmospheric residuum were the materials utilized during a deasphalting process with 20/80 LV% butane/propane mixture. Typical properties of the two materials are summarized below in Table I.

TABLE I

TYPICAL COMPONENT FEED PROPERTIES

| | RESIDfined Vacuum Bottoms | FCCU Fractionator Bottoms |
|---|---|---|
| Viscosity, cSt @ 100° C. | 265 | 19.1 |
| Density, kg/dm$^3$ @ 15° C. | 1.0032 | 1.0721 |
| Ni/V, ppm | 38/72 | 2.5/6.3 |
| CCR, wt % | 15.8 | 7.5 |
| Sulphur, wt % | 1.2 | 1.5 |
| C/H, atomic | 0.70 | 0.93 |

The formation and inhibition of a third immiscible phase was demonstrated by admixing in the listed LV% proportion, an aromatic stream (38), being the tar bottoms from the fractionator of a fluidized catalytic cracking unit (FCCU), with the above-described vacuum distilled RESIDfined atmospheric residuum as a deasphalter feed to a commercial plant deasphalting unit. The feedstock mixture was contacted in a countercurrent fashion with a 20/80 LV% butane/propane mixture. The results are listed below in Table II. As is seen, admixture with 30 LV% FCCU bottoms as the aromatic stream eliminated the third phase formation. Further, admixing of FCCU fractionator bottoms with the deasphalter feed resulted in greatly improved heat transfer and more efficient cooling of the feed to the deasphalting zone. Up to 15° C. of increased cooling became available over a period of about 20 hours after the admixing of 30 LV% aromatic stream with the RESIDfined residuum.

TABLE II

DEASPHALTING RESIDfined BOTTOMS WITH FCCU FRACTIONATOR BOTTOMS-BATCH DEASPHALTER RESULTS

| Feed Composition LV % RESIDfined Bttms/ FCCU Bttms | Wt % Immiscible Third Phase/Feed |
|---|---|
| 100/0 | 9 |
| 90/10 | 7 |
| 80/20 | 5 |
| 70/30 | 0 |
| 60/40 | 0 |
| 0/100 | 0 |

*It is possible to operate the deasphalter with 20 LV% FCCU bottoms for a period of time. However, the feed precoolers gradually become fouled. This situation can be rectified by increasing the FCCU bottoms to 30 LV% in the deasphalter feed until the feed precoolers return to their maximum efficiency.

EXAMPLE 2

Utilizing a 100% Residfined Bottoms mixture as a base case, this was run and compared to the 30 LV% FCCU Bottoms case from Example 1. The results are listed below in Table III.

TABLE III

Improved Deasphalting of Residfined Bottoms with FCCU Bottoms Addback - Refinery Data

| | Base Case | Test Run |
|---|---|---|
| Feed Compos, LV % RESIDfined Bottoms/ FCCU Bottoms | 100/0 | 70/30 |
| Deasphalting Conditions | | |
| Comparative Tower Top Temp, °C. | A | about 11° C. lower than A |
| Comparative Treat LV %[a] | B | 1.4 times B |
| DAU Feed Properties | | |
| Viscosity, cSt @ 100° C. | 265 | 187 |
| Density, kg/dm$^3$ @ 15° C. | 1.0032 | 1.0135 |
| Ni/V, ppm | 38/72 | 36/67 |
| CCR, wt % | 15.8 | 16.0 |
| Sulphur, wt % | 1.2 | 1.3 |
| C/H, Atomic Ratio | 0.70 | 0.74 |
| DAO Properties | | |
| Viscosity, cSt @ 100° C. | 32 | 25 |
| Density, kg/dm$^3$ @ 15° C. | 0.9267 | 0.9614 |
| Ni/V, ppm | 0.8/0.9 | 0.8/1.2 |
| CCR, wt % | 2.4 | 2.7 |
| Sulphur, wt % | 0.54 | 0.82 |
| RI @ 75° C. | 1.4984 | 1.5280 |
| C/H, Atomic Ratio | 0.59 | 0.65 |
| Comparative DAO Yield, LV % | 1.0 | 1.9 |
| Comparative Deasphalter Capacity | 1.0 | 1.8–2.0 |

[a]Propane/butane solvent mixture.

As is seen in Table III, there is a corresponding improvement of up to 90% in deasphalted oil yield on feed by admixing of 30% FCCU bottoms with the deasphalter feed in a fuels operation.

The results clearly indicate that the quality of the deasphalted oil for further downstream processing in a catalytic cracking unit can be maintained while substantially higher yields of oil are being produced. In addition, severe throughput limitations experienced on the deasphalting treater towers, in the absence of FCCU bottoms, addition, were removed, allowing up to 100% higher charge rates in the process.

What is claimed is:

1. A process for increasing the production of deasphalted oil from a hydrocarbon feedstock comprising the steps of:

(a) passing the hydrocarbon feedstock into a first distillation zone wherein the feedstock is separated into distillates and a first residuum;

(b) passing said first residuum into a hydrotreating zone operating between about 315° C. to 425° C., at an absolute pressure between 4000 to 10,000 cmHg wherein a hydrotreated first residuum is produced;

(c) passing said hydrotreated first residuum into a second distillation zone wherein it is separated into distillates and a hydrotreated distillation residuum; and (d) mixing said hydrotreated distillation residuum with a solubilizing aid selected from the group consisting of catalytic cracker fractionator bottoms having an initial boiling point not less than 260° C. and not more than 430° C. (at 1 atmosphere), heavy cycle gas oil having a boiling point range of 200° C. to 420° C. (at 1 atmosphere) and heavy coker gas oil having a boiling point range of 300° C. to 550° C. (at 1 atmosphere) and feeding the resultant mixture into a deasphalting zone wherein said solubilizing aid comprises 30 to 60 LV% of the total feed to the deasphalting zone wherein the hydrotreated distillation residuum and solubilizing aid are contacted with a deasphalting solvent producing a liquid deasphalted oil extract and an asphaltic raffinate, wherein said solubilizing aid inhibits the formation of a third asphaltic phase by promoting the solubility of said third phase in said asphaltic raffinate.

2. The process of claim 1 wherein the deasphalting solvent is selected from the group consisting of $C_2$–$C_8$ alkanes and mixtures thereof.

3. The process of claim 1 wherein said deasphalting solvent comprises a propane/butane mixture.

4. A process for increasing the production of deasphalted oil from a hydrocarbon feedstock comprising:

(a) passing a hydrocarbon feedstock into a first distillation zone at a temperature of about 260° to 415° C. and about atmospheric pressure wherein the feed is separated into distillates and a first residuum;

(b) passing the first residuum into a catalytic hydrotreating zone at a temperature of about 315°–425° C. and absolute pressure of about 4000 to 10,000 cm Hg, wherein an upgraded first residuum is produced;

(c) passing the upgraded first residuum into a second distillation zone at a temperature of about 350°–450° C. and a pressure between about 5–15 cm Hg, wherein it is separated into distillates and a second residuum having a boiling point above 370° C.;

(d) mixing the second residuum with catalytic cracker fractionator bottoms wherein said catalytic cracker fractionator bottoms have an initial boiling point of not less than 260° C. and not more than 430° C. (1 atm.), in a 70/30 LV% admixture and passing said admixture into a deasphalting zone wherein said admixture of second residuum and said cat cracker bottoms is contacted with a propane/butane solvent in an 80/20 LV% admixture to produce a two phase system containing liquid deasphalted oil extract and a liquid asphaltic raffinate.

* * * * *